US006774545B1

(12) United States Patent
Zhou et al.

(10) Patent No.: US 6,774,545 B1
(45) Date of Patent: Aug. 10, 2004

(54) REFLECTOR LAMPS

(75) Inventors: Yutao Zhou, Richmond Heights, OH (US); Thomas M. Golz, Willoughby Hills, OH (US); Tianji Zhao, Mayfield Heights, OH (US); Rajasingh Israel, Westlake, OH (US); Ashfaq Chowdhury, Mayfield Heights, OH (US)

(73) Assignee: General Electric Company, Schenectady, NY (US)

( * ) Notice: Subject to any disclaimer, the term of this patent is extended or adjusted under 35 U.S.C. 154(b) by 211 days.

(21) Appl. No.: 09/710,675

(22) Filed: Nov. 9, 2000

(51) Int. Cl.[7] ..... H01J 5/16
(52) U.S. Cl. ..... 313/113; 313/25; 313/252
(58) Field of Search ..... 313/26, 33, 46, 313/110, 242, 113, 25, 42; 362/294, 365, 296, 297, 310, 341, 345, 347, 350

(56) References Cited

U.S. PATENT DOCUMENTS

| | | | | | |
|---|---|---|---|---|---|
| 4,242,725 | A | | 12/1980 | Douma et al. | |
| 4,433,271 | A | * | 2/1984 | Inoue et al. | 313/239 |
| 4,437,145 | A | * | 3/1984 | Roller et al. | 372/306 |
| 4,447,865 | A | | 5/1984 | VanHorn et al. | |
| 4,451,873 | A | * | 5/1984 | Tyler et al. | 362/267 |
| 4,536,834 | A | | 8/1985 | Sands et al. | |
| 4,587,601 | A | | 5/1986 | Collins | |
| 4,728,848 | A | * | 3/1988 | Walsh | 313/113 |
| 4,755,916 | A | | 7/1988 | Collins | |
| 5,057,735 | A | * | 10/1991 | Zalar et al. | 313/113 |
| 5,506,464 | A | * | 4/1996 | Ooms | 313/113 |
| 5,964,522 | A | | 10/1999 | Schaefer et al. | |
| 6,053,624 | A | | 4/2000 | Cronk | |
| 6,161,946 | A | * | 12/2000 | Bishop et al. | 362/302 |
| 6,280,061 | B1 | * | 8/2001 | Kokado | 362/296 |

* cited by examiner

*Primary Examiner*—Edward J. Glick
*Assistant Examiner*—Elizabeth Keaney
(74) *Attorney, Agent, or Firm*—Pearne & Gordon LLP

(57) ABSTRACT

A parabolic reflector lamp is provided wherein lamp efficiency is improved by more substantially approximating the shape of a complete parabola at the inner reflective surface. In a first embodiment, the heat shield is placed at the mouth of the opening at the base of the lamp, thereby "filling in" the opening and substantially completing the parabolic shape of the reflector. In a second embodiment, the opening at the base of the lamp is narrowed to minimize its cross-sectional area and maximizing reflective surface area. In a third embodiment, the glass shell of the lamp is provided in a two-piece configuration, allowing the size of the hole through the base of the glass shell to be reduced. The openings required to accommodate electrodes (and an exhaust tube in sealed lamps) are located in a second cup-shaped piece attached via a flange to the main body of the glass shell.

30 Claims, 6 Drawing Sheets

REFLECTOR LAMPS

BACKGROUND OF THE INVENTION

This invention relates to reflector lamps. More particularly, it relates to parabolic aluminized reflector lamps.

Parabolic aluminized reflector (PAR) lamps are known in the lighting art. Ideally, a PAR lamp comprises a completely parabolic-shaped glass shell, which is coated with a reflective aluminum substance to form a parabolic reflector. A wire lamp is disposed within the glass shell. A major drawback of this type of lamp is lumen efficiency. A primary reason for the lack of efficiency is that the lamps are not completely parabolic in shape. Instead, the base of the lamp, referred to herein as the "nose chamber" and located at the low point of the parabola, is either completely open or is closed but contains a number of openings. The openings provide portals for connecting electrical leads to the wire lamp, and for an exhaust tube for sealed lamps. Consequently, a significant portion of the base of the parabolic reflector is absent in traditional PAR lamps, thus greatly reducing their efficiently. Because the reflective surface is not a full parabola, some light is either lost in the nose chamber or must be reflected multiple times before it can exit the lamp. Such light loss and multiple reflectivity greatly reduce the efficiency of the lamp.

Thus, it is desired to improve the efficiency of PAR lamps by maximizing the reflective surface of the lamp. It is also desired to improve the efficiency of PAR lamps by modifying the base of the lamp to more completely approximate a parabola, and to minimize the cross-sectional area of the nose portion of the base.

It is also desired to increase the life of PAR lamps by reducing the temperature in the nose chamber.

Finally, it is desired to reduce the risk of short circuit due to contact between the metal leads of the wire lamp and the aluminum reflective coating.

SUMMARY OF THE INVENTION

A first embodiment of a reflector lamp is provided comprising a glass shell that has a concave inner surface, an outer surface, and an opening through the base of the glass shell forming a nose portion thereof. The reflector lamp also comprises a reflective coating on the concave inner surface, a wire lamp within the shell, and a heat shield in the mouth of the opening in the base of the glass shell, substantially completing the shape of the concave inner surface.

A second embodiment of a reflector lamp is provided comprising a base, a wire lamp, and a glass shell that has a concave inner surface, an outer surface, and a reflective coating on the inner surface. The glass shell further comprises a bottom having an opening therein, which opening forms the top of a slot disposed within the base. The slot has a major diameter and a minor diameter such that the major diameter is substantially longer than the minor diameter. The wire lamp is disposed within the glass shell, and extends into the slot. A third embodiment of a reflector lamp is provided comprising a glass shell, a wire lamp, and a flange, wherein the glass shell has a concave inner surface, an outer surface, and a reflective coating disposed on the inner surface. A wire lamp is disposed within the glass shell. The flange extends from the outer surface of the glass shell and defines a perimeter of a chamber. An extension of the glass shell extends over the chamber defined by the flange. The extension of the glass shell has an inner surface coated with the reflective coating, and an opening therethrough in communication with the chamber defined by the flange.

DETAILED DESCRIPTION OF THE PREFERRED EMBODIMENTS

In the description that follows, when a preferred range, such as 5 to 25 (or 5–25) is given, this means preferably at least 5, and separately and independently, preferably not more than 25.

"Lumen efficiency" as used herein means the ratio of lumen output from a PAR lamp to the total lumens generated by the wire lamp within the PAR lamp. Simply, it is the ratio of lumen output to total generated lumens.

Figure 1:
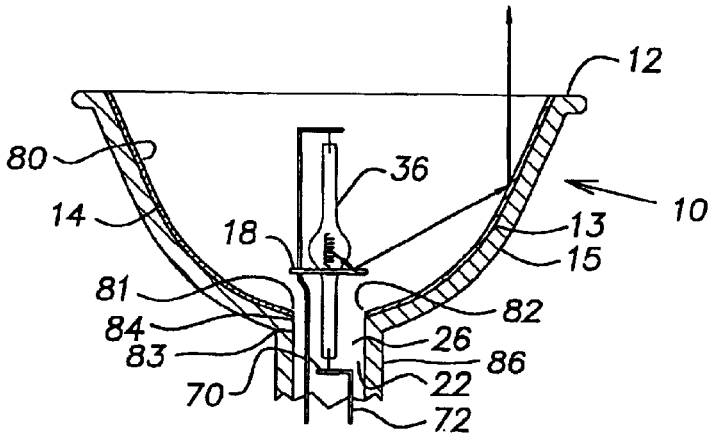
FIG. 1 PRIOR ART
FIG. 1 is a cross-sectional view of a prior art parabolic reflector lamp.
Figure 2:
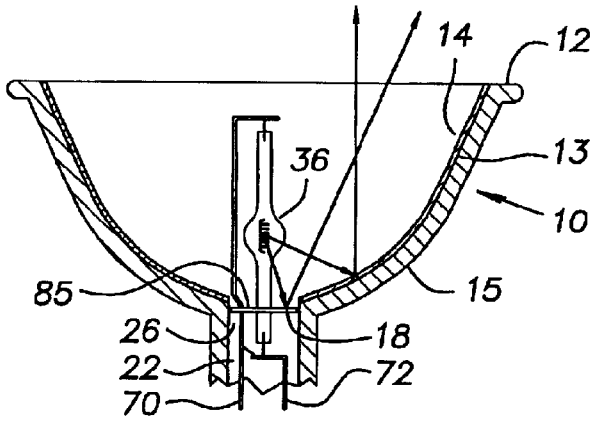
FIG. 2 is a cross-sectional view of a first embodiment of a parabolic reflector lamp of the present invention taken along line 2—2 of FIG. 3.

FIG. 1 shows a traditional PAR lamp 10 comprising a substantially parabolic glass shell 12 having an inner surface 13 with a reflective coating 14 disposed thereon, an outer surface 15, a wire lamp 36 which is well known in the art, and a heat shield 18. The reflective coating 14 typically comprises aluminum, though the reflective coating 14 can also comprise silver, gold, white gold, chromium or any other suitable reflective material. The glass shell 12 has an opening at its bottom to which is attached or formed a base 86 which defines a nose chamber 22. The electrical leads 70, 72 to the wire lamp 36 are shown in FIGS. 1 and 2. The nose chamber 22 has a mouth 26 located adjacent the base of the parabola. The heat shield 18 prevents heat from radiating from the wire lamp 36 to the nose chamber 22. Without the heat shield 18, the nose chamber 22 is exposed to higher temperatures within, thereby reducing the functional life of the lamp 10.

The heat shield 18 comprises any material sufficiently reflective of both of infrared (IR) radiation (to minimize radiant heating of the nose chamber 22), and visible light (to improve the efficiency of the lamp 10); e.g. stainless steel, or, more preferably, a silicon-coated silver layer deposited on a disk substrate. In the traditional lamp arrangement shown in FIG. 1 the heat shield 18 is located immediately below the light-emitting portion of the wire lamp 36. The efficiency of the lamp 10 is low with the heat shield 18 in this position because a large portion of light emitted from the wire lamp 36 is reflected off the lower-reflectivity heat shield and this portion of light bounces more than once before leaving the PAR lamp, as illustrated in FIG. 1. Each reflection results in approximately a 15% loss in lumens. Moving the heat shield 18 to a position where it substantially completes the parabola significantly reduces multiple reflectivity as shown in FIG. 2, and reduces the amount of light hitting the heat shield. As multiple reflections are eliminated, the overall efficiency of the lamp 10 is increased.

Figure 3:
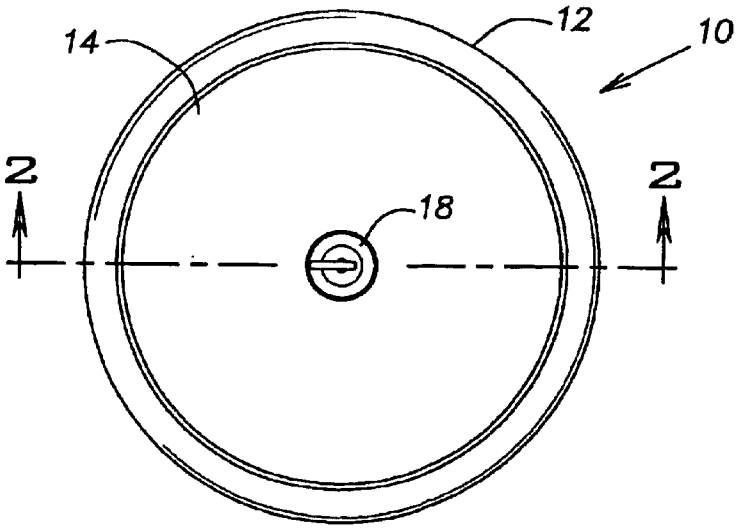
FIG. 3 is a top view of the lamp of FIG. 2.

In the embodiment of the invention shown in FIGS. 2 and 3, the efficiency of the lamp 10 is increased by changing the location of the heat shield 18 so that it is substantially within or adjacent the nose chamber 22. The heat shield 18 is moved from its position immediately adjacent the bulb 37 of wire lamp 36 to a position where it rests preferably even with the mouth 26 of the nose chamber 22. In its new position, the heat shield 18 "fills in" the mouth 26 of the nose chamber 22, substantially completing the parabolic reflector. The top surface 85 of the heat shield 18 preferably forms a continuation or substantial continuation of the top or inner surface 80 of reflective coating 14. In addition to maximizing the optical efficiency of the lamp, placing the heat shield within mouth 26, immediately adjacent to 81, 82, minimizes heating of the nose chamber, and is thus the optimum position for thermal function of the heat shield.

As will be understood by one skilled in the art, PAR lamps of the sort contemplated in the present invention normally operate in an inverted position; that is, with the open end of the parabolic reflector facing downward from a ceiling toward a floor below, and the nose portion screwed into a light fixture contained in the ceiling via a threaded connection as is well known in the art. (See FIG. 16).

Figure 16:
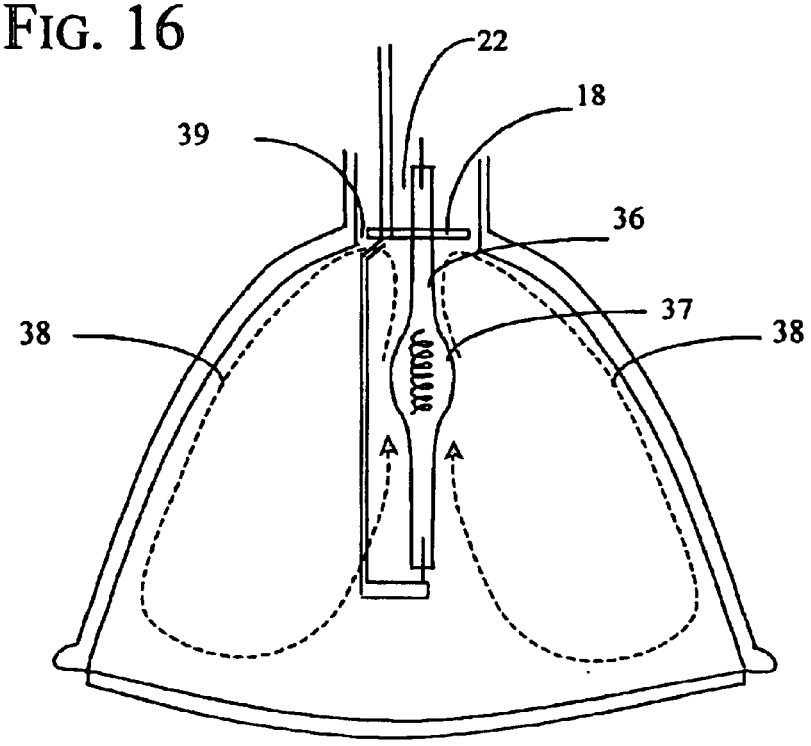
FIG. 16 is a cross-sectional view of a preferred embodiment of the parabolic reflector lamp according to the present invention.

During operation, the hottest part of the lamp is the bulb portion 37 of the wire lamp 36. As air adjacent the bulb portion 37 is heated, its density is decreased. This low-density heated air rises through the surrounding cooler air of lower density, and impacts the heat shield 18. With the heat shield in its most preferred position, in the mouth 26 of the nose chamber 22 such that its top surface 85 substantially completes the parabola, the hot air flows naturally along the curvature of the parabola following a circular convective path 38 as shown in FIG. 16. In this manner, heated air is prevented from entering the nose chamber in the most efficient manner possible.

With the heat shield in its optimum position as described above, the area of the open annulus 39 between the edge of the heat shield and the edges 81, 82 of coating 14 (also the edges of mouth 26) is minimized. Preferably, the heat shield has a diameter such that the width of the open annulus 39 is no greater than 2, preferably 1.5, preferably 1, preferably 0.9, preferably 0.8, preferably 0.7, preferably 0.6, preferably 0.5, mm.

Less preferably, the heat shield 18 can be placed slightly above or slightly below its optimum position, for example, within 5, preferably 4, preferably 3, preferably 2, preferably 1.5, preferably 1, mm above or below mouth 26. The heat shield 18 may, for example, may be placed in the cylinder having a top at 81, 82 and a bottom at 83 (the cylinder thus having a height substantially equal to the thickness of the coating 14 and glass shell 12 combined). In this case, it is preferred that the heat shield 16 is placed in the top half of the cylinder just defined, that is, in the cylinder having a top at 81, 82 and a bottom at 84, which is approximately the midpoint of the thickness of the glass shell 12. Less preferably, the heat shield 18 can be placed slightly beneath the shell 12, that is, below location 83. Less preferably, the heat shield can be placed slightly above (within 1 or 2 mm above) the coating 14. However, it should be noted that, in placing the heat shield in one of these less preferred positions, both thermal and optical efficiency of the heat shield decrease. The negative optical effects have already been discussed. By locating the heat shield in a recessed position within the nose chamber 22, a cavity is created between the edges 81, 82 (refer to FIG. 1) and the heat shield within which air cannot circulate. This dead space creates a pocket of stagnant hot air, thus significantly increasing the temperature of the nose portion, thereby defeating the function of the heat shield. Conversely, by placing the heat shield above the edges 81, 82, the space between the heat shield 18 and the edges 81, 82 is increased, thus providing a larger portal through which hot air may be convected into the nose chamber 22, again defeating the function of the heat shield.

Optionally, the heat shield 18 can be provided in a concave curved-shape to more closely approximate the parabolic shape of the reflective coating 14. It should be noted that when in its optimum position, the heat shield 18 has a slightly smaller diameter than the mouth 26 of the nose chamber 22 so as not to contact the reflective coating 14, thereby increasing the risk of short-circuiting the electrical leads 70, 72. By moving the heat shield 18 to the mouth 26 of the nose chamber 22, the overall efficiency of the lamp 10 is increased from approximately 70% to 80%.

In its optimum position adjacent edges 81, 82, the heat shield 18 further serves its primary function of reducing the temperature of the nose chamber 22 because the IR-reflecting material of the heat shield reflects the IR radiation out of the lamp, away from the nose chamber 22. Thus, the IR radiation does not enter the nose chamber 22 and, in turn, the temperature in the nose chamber 22 is reduced leading to longer lamp life.

Figure 4:
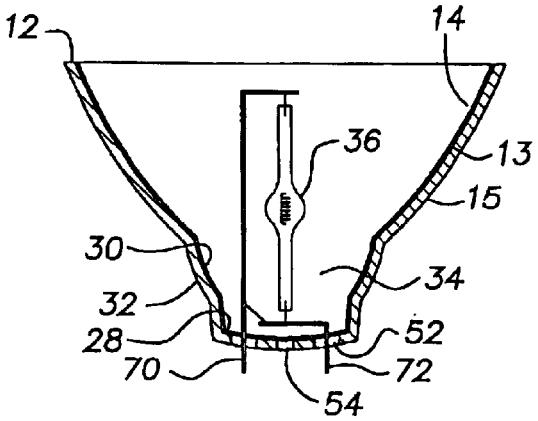
FIG. 4 PRIOR ART
FIG. 4 is a cross-sectional view of a prior art parabolic reflector lamp taken along 4—4 of FIG. 5, including a wire lamp.
Figure 5:
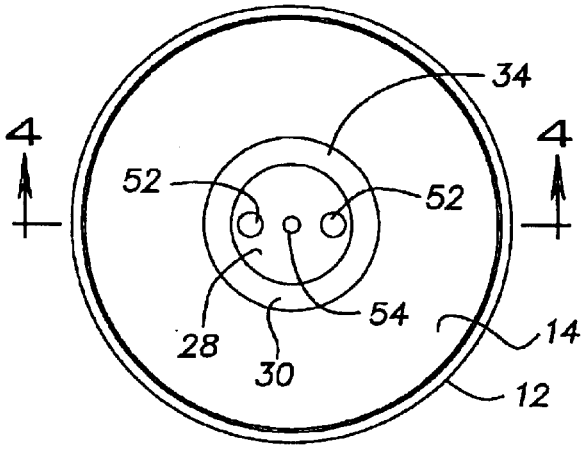
FIG. 5 PRIOR ART
FIG. 5 is a top view of the parabolic reflector lamp of FIG. 4 but not including a wire lamp.

In a second preferred embodiment of the invention, the efficiency of the lamp is increased by a new shape of the glass shell 12 onto which is deposited the reflective coating 14. A second type of traditional PAR lamp is illustrated in FIGS. 4 and 5, wherein a nose chamber 34 comprises a secondary parabola 30 and a closed circular base 28 having holes or openings 52, 54, for an exhaust tube (not shown) and ferrules (not shown) that provide conduits for connecting the electrical leads 70, 72 from the wire lamp 36 to a screw base (not shown). As can be seen in FIG. 4, the secondary parabola 30 of this second type of traditional PAR lamp subtends the primary parabolic reflector, and together with it forms a substantially conically shaped reflector about the filament of the wire lamp 36. Light incident to the secondary parabola 30 near the base thereof is either absorbed by the interior surface of the nose chamber 34, or is multiply reflected prior to being directed toward the opening of the lamp 10. Furthermore, some second-reflected light will be blocked from exiting the lamp 10 by the wire lamp 36.

Figure 6:
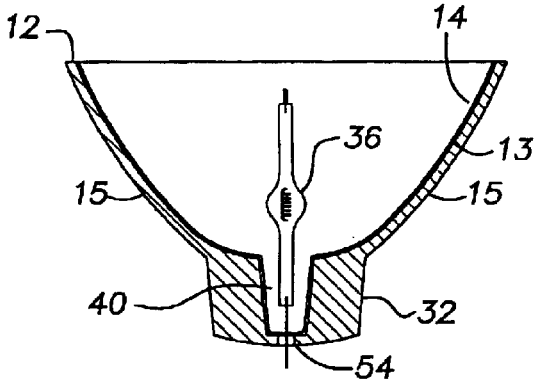
FIG. 6 is a cross-sectional view of a second embodiment of a parabolic reflector lamp of the present invention, including a wire lamp, taken along line 6—6 of FIG. 8.
Figure 7:
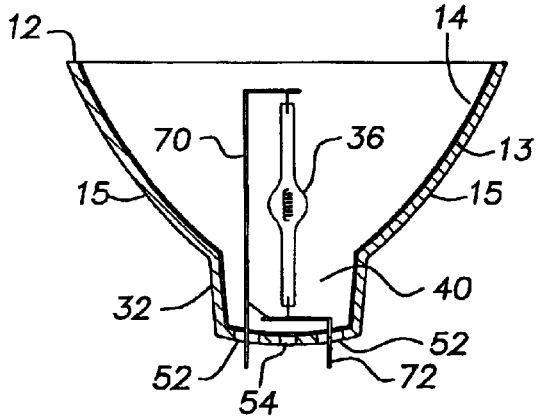
FIG. 7 is a cross-sectional view of the lamp of FIG. 6, taken along line 7—7 of FIG. 8.
Figure 8:
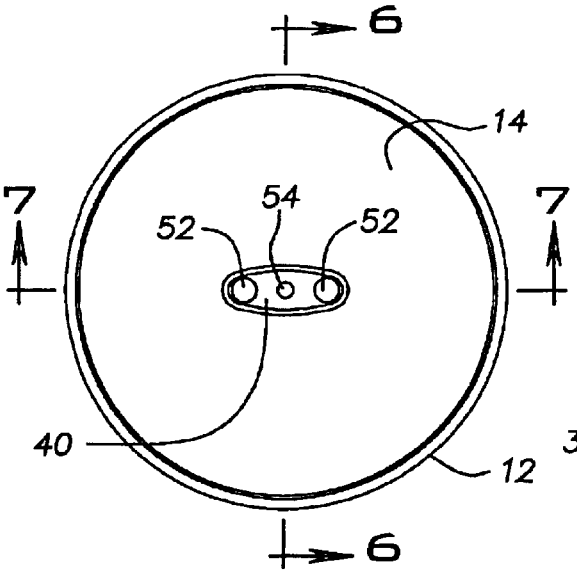
FIG. 8 is a top view of the lamp of FIG. 6, but not including a wire lamp.

To solve this problem, the shape of the nose chamber 34 is modified according to a second preferred embodiment of the present invention wherein the relatively wide circular opening of the nose chamber 34 is reduced to a relatively narrow slot or opening 40 as illustrated in FIGS. 6–8, eliminating the secondary parabola 30. The slot has a major diameter and a minor diameter, wherein the major diameter is 1.5, preferably 2, preferably 3, preferably 4, preferably 5, (though typically 4), times longer than the minor diameter thereof. The minor diameter of the slot 40 is only wide enough to accommodate the wire lamp 36 and electrical leads 70, 72, and has at its base a plurality of openings 52, 54 to accommodate ferrules (not shown) through which the electrical leads 70, 72 pass, and an exhaust tube (also not shown). Preferably three openings 52, 54 are provided, less preferably one, two, or more than three openings, which extend through the inner surface 13 and the outer surface 15 at the bottom of the slot 40. The slot 40 can be any shape that will accommodate the wire lamp 36 and electrical leads 70, 72. Preferably, the slot 40 is substantially rectangular or, if fabricating a rectangle is costly, the corners can be rounded so the slot 40 has a substantially elliptical shape when viewed from above. By narrowing the nose chamber 34, the lamp more closely approximates the desired parabolic shape, and the efficiency of the lamp is increased while leaving sufficient area to accommodate openings 52, 54.

However, narrowing the nose chamber 34 without changing the shape of the exterior of the base 32 leads to a high volume of glass in the base 32 of the lamp 10. When the glass for the lamp 10 is shaped and cooled, it is important that the glass throughout the lamp cools at the same rate. When portions of the glass cool at different rates, the glass can deform and lose its shape. Increased glass volume leads to an uneven cooling rate at the base 32, and thus, the base 32 deforms upon cooling.

Figure 9:
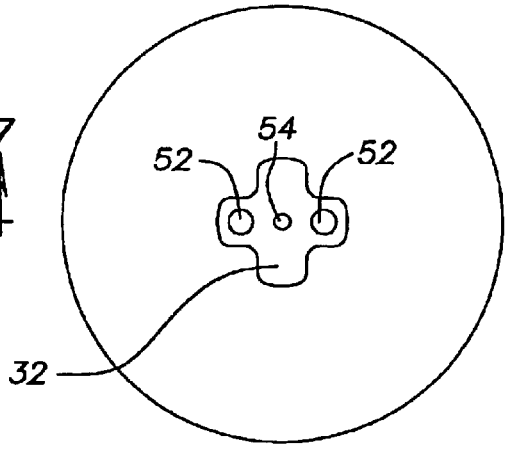
FIG. 9 is a bottom view of the lamp of FIG. 6.

This problem is solved by eliminating the excess glass in the outer portion of the base 32. Specifically, the shape of the outside of the base 32 is modified according to the present invention from circular to substantially cross-shaped. The base 32 need not be perfectly cross-shaped as shown in FIG. 9. The corners of the cross may be rounded for ease of fabrication. The cross-shape eliminates excess glass volume in the base 32 that otherwise would contribute to uneven cooling during the forming process.

Compared to the lamp design of the prior art (as illustrated in FIGS. 4 and 5), a lamp 10 of the present invention (as illustrated in FIGS. 6–9) has a much narrower opening at the parabolic reflector for a lamp of the same size. It should be noted that the exact dimensions of the slot 40 will depend on the size of the lamp 10.

Figure 17:
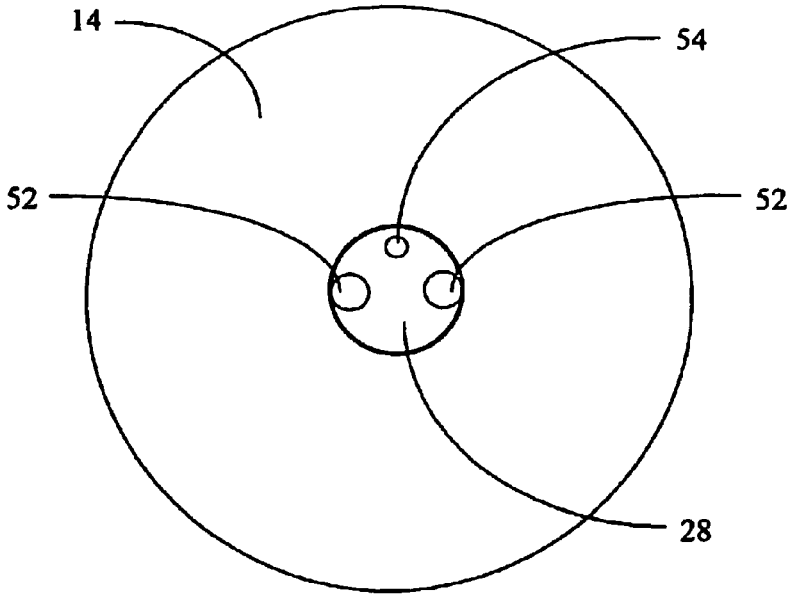
FIG. 17 is a top view of a parabolic reflector lamp having three holes through a base thereof, with one of the three holes offset from center to accommodate minimizing the diameter of the base according to a preferred embodiment of the present invention.

Optionally, the relatively large diameters of both the nose chamber 34 and closed circular base 28 thereof (typically about 1.1 inches) as seen in FIG. 5 can be narrowed in the following manner. In traditional PAR lamps as illustrated in FIGS. 4–5, a wide base 28 was necessary to accommodate openings 52,54 for electrical leads 70,72 and an exhaust tube 58 as explained above. However, the diameter of the nose chamber 34 and base 28 of the PAR lamp may be reduced by moving opening 54 from its central position as shown in FIG. 5 to a new offset position as shown in FIG. 17. In this embodiment, the opening 54 preferably is positioned offset from center such that the diameter of the nose chamber 34 (and base 28) is no greater than 1, preferably 0.95, preferably 0.90, preferably 0.85, preferably 0.82, inches. The opening 54 is preferably offset from center of base 28 such that the distance from the center of 54 to the center of 52 is no less than 6, more preferably 7, more preferably 8, more preferably 9, more preferably 10, more preferably 11, mm. It is believed that by reducing the diameter of the nose chamber 34 and base 28 in this manner, lumen efficiency can be improved from about 70%, typical of the prior art, to approximately 80%.

In a third embodiment of the invention, the efficiency of the lamp 10 is increased by making the shape of the glass shell 12 more closely approximate a parabola. In this embodiment, glass shell 12 is formed as two pieces instead of a single piece. As discussed above in conjunction with a previous embodiment, in traditional PAR lamps (as illustrated in FIGS. 4 and 5) the base 32 contains a nose chamber 34 having holes 52, 54 at its base to accommodate an exhaust tube and ferrules. This configuration results in inefficiency because the nose chamber 34 subtends to a substantially linear acute angle about the filament of the wire lamp 36. Light incident to the nose chamber 34 is either absorbed by the interior surface thereof, or requires multiple reflections before being directed toward the opening of the reflector. Furthermore, some second-reflected light will be blocked by the wire lamp 36.

To alleviate this problem in the present embodiment (shown in FIGS. 10–15), a plurality of holes or openings 52, 54, preferably three openings 52, 54, less preferably one, two, or more than three openings, (to accommodate ferrules 56 and exhaust tube 58) are disposed in the base 76 of a glass cup 60. The glass cup has a perimeter wall 78 attached to and extending upward from the base 76, which, when the lamp 10 is fully assembled, is permanently attached to a flange 62 formed integrally with and extending downward from the base 64 of the lamp 10, defining a perimeter of a chamber 74. Preferably, the cup 60 and flange 62 are of equivalent diameter such that the top edge of perimeter wall 78 engages the bottom edge of flange 62 in the final assembled position. Less preferably, the cup 60 is sized such that its perimeter wall 78 slides into the chamber 74 defined by flange 62 in the final assembled position. Preferably, the glass cup 60 and flange 62 both have circular cross-sections, though any suitable shape may be used.

The perimeter wall 78 of the glass cup 60 is attached to the flange 62 by any means known in the art. Suitable means include fusing, clamping and the use of o-rings. Preferably, the glass cup 60 is connected to the flange 62 by fritting, wherein frit glass is applied to the flange 62, or alternatively, to the glass cup 60, and the frit glass is heated slightly above its melting temperature (which is less than that of the glass used to make the glass cup 60 and flange 62) with both components in their final assembled position. The frit glass is allowed to cool, wherein it solidifies, thus joining the flange 62 and glass cup 60.

As illustrated in FIGS. 10–13, the base 64 now has only a small key-shaped hole or opening 66 that is large enough to allow the wire lamp 36 and one of its electrical leads 70 to pass through. The second lead 72 does not pass through the key-shaped hole 66. Because the base 76 of the glass cup 60 does not have a reflective coating, the chance of a short-circuit resulting from both electrical leads 70, 72 contacting a metallic reflective coating is reduced.

Figure 10:
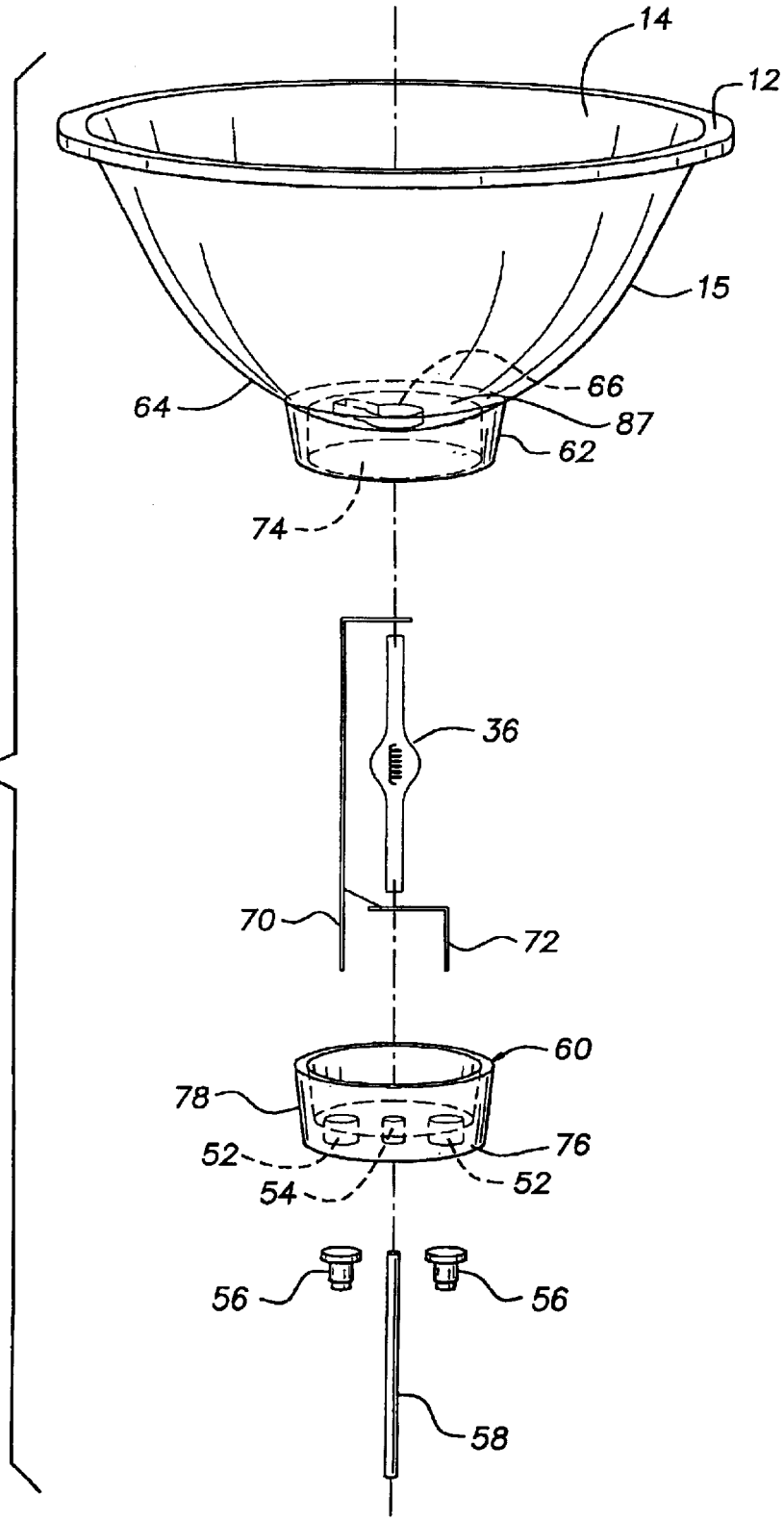
FIG. 10 is an exploded perspective view of a third embodiment of a parabolic reflector lamp of the present invention.
Figure 12:
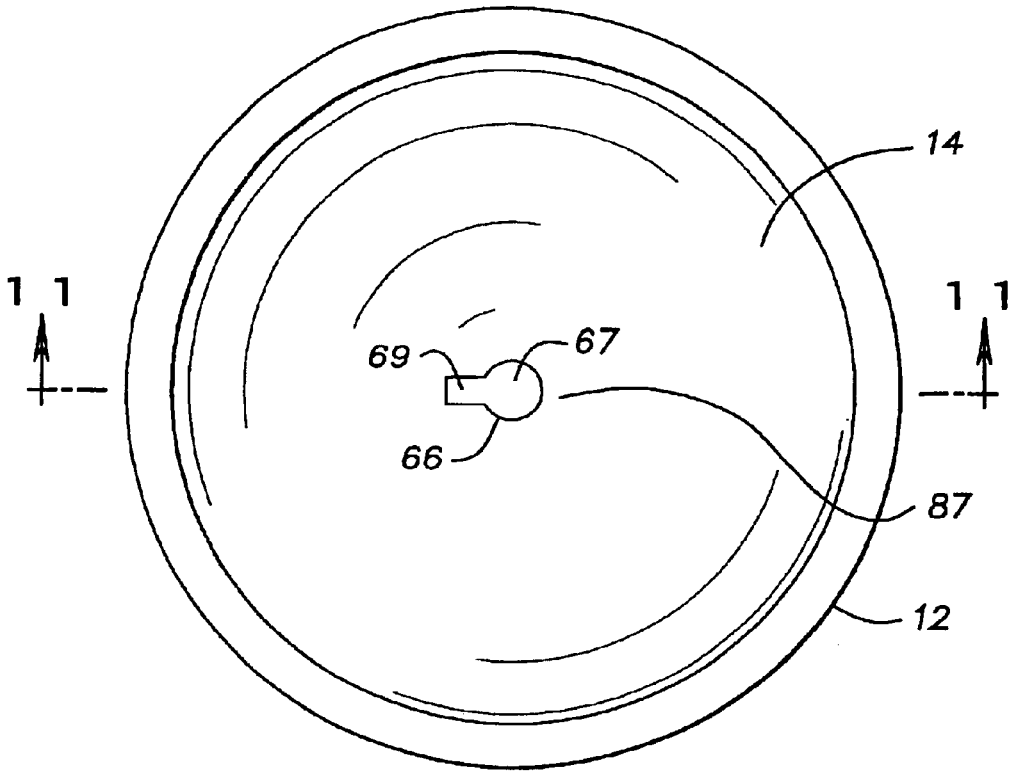
FIG. 12 is a top view of the glass shell of FIG. 10, not including a wire lamp.
Figure 11:
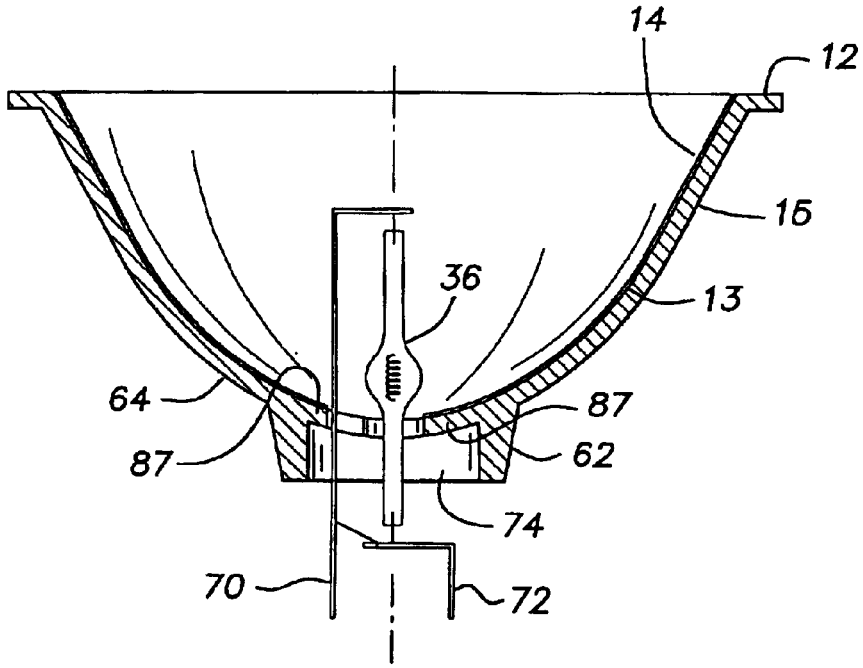
FIG. 11 is a cross-sectional view of a glass shell of the lamp of FIG. 10 taken along line 11—11 of FIG. 12, including a wire lamp.
Figure 13:
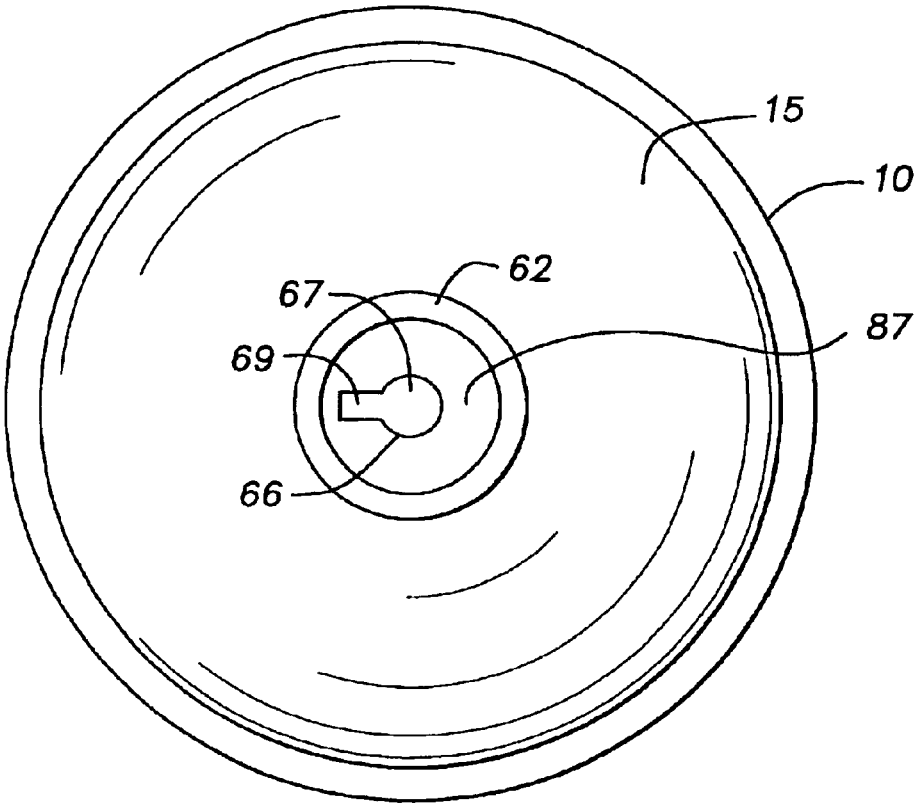
FIG. 13 is a bottom view of the glass shell of FIG. 10.
Figure 14:
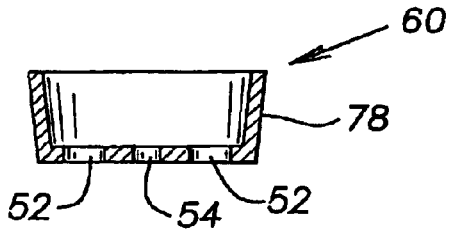
FIG. 14 is a cross-sectional view of the glass cup of FIG. 10, taken along line 14—14 of FIG. 15.
Figure 15:
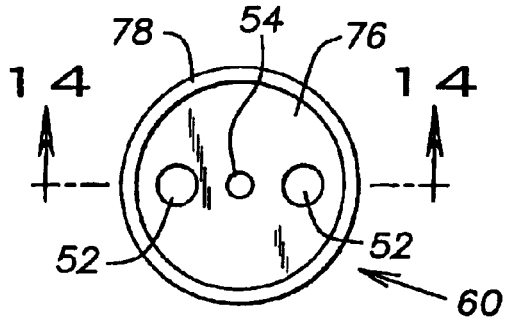
FIG. 15 is a top view of the glass cup of FIG. 10.

The key-shaped hole or opening 66 may be of any shape that minimizes the size of the opening, yet is large enough for a wire lamp 36 and electrical lead 70 to pass through. Preferably, the opening 66 is key-shaped, i.e. having a substantially circular portion 67 with a substantially rectangular portion 69 extending therefrom (as best shown in FIG. 12). In this manner, the parabolic reflector has the maximum possible surface area while still providing an opening to accommodate the wire lamp 36 and electrical lead 70. This design is particularly effective because the interior reflective surface of the parabolic reflector has an extension or extension flange or overhang portion 87 that overhangs the chamber 74 defined by flange 62 as best seen in FIG. 11. Also, as shown in FIGS. 10 and 11, the extension 87 has an opening therethrough in fluid communication with the chamber 74 to accommodate the wire lamp 36 and electrical lead 70. This represents a significant improvement in reflective surface area over the prior art as illustrated in FIG. 4, because at least 20, preferably 30, preferably 40, preferably 50, preferably 60, preferably 70, preferably 80, preferably 90, percent of the open space over the nose chamber 34 of the prior art has been replaced in the present embodiment by additional parabolic reflective surface on the extension or overhang portion 87.

The base 76 of the glass cup 60 has a plurality of holes 52 and 54, typically three holes, extending therethrough. Ferrules 56 are disposed within the holes 52 such that the ferrules 56 provide sealed contact means for connecting the electrical leads 70 and 72 of the wire lamp 36 to the screw base. An exhaust tube 58 is fused to a hole 54 in the base 76 of the glass cup 60. In this manner, the wire lamp 36 may be evacuated, filled with inert gas, and the exhaust tube sealed by "pinching" the end as is known in the art once the glass cup 60 has been attached to the flange 62.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A reflector lamp comprising a glass shell, a base, a wire lamp, and a heat shield, said wire lamp being disposed within said glass shell, said glass shell having a concave inner surface and an outer surface, said glass shell having a thickness, said glass shell having a reflective coating disposed on said inner surface, said glass shell having a bottom, said glass shell having an opening at said bottom, said base extending from said bottom of said glass shell, said opening and said base defining a nose chamber, said heat shield being disposed substantially within or adjacent said nose chamber, said nose chamber having a sealed-off exhaust hole in a base of said nose chamber, said sealed-off exhaust hole being substantially offset from a center of said base of said nose chamber, said base of said nose chamber having a diameter of no greater than 1 inch.

2. A reflector lamp according to claim 1, wherein said concave inner surface is substantially parabolic.

3. A reflector lamp according to claim 2, wherein said heat shield is positioned so as to substantially complete said parabolic inner surface.

4. A reflector lamp according to claim 1, wherein said heat shield is a concave curved-shape.

5. A reflector lamp according to claim 1, wherein said heat shield comprises stainless steel.

6. A reflector lamp according to claim 1, wherein said heat shield comprises a substrate and a reflective coating disposed on said substrate.

7. A reflector lamp according to claim 6, said reflective coating on said substrate comprising chromium.

8. A reflector lamp according to claim 1, wherein said nose chamber has a plurality of sealed-off holes disposed in said base of said nose chamber.

9. A reflector lamp according to claim 8, wherein the number of said sealed-off holes is three.

10. A reflector lamp according to claim 1, wherein said base of said nose chamber has a diameter of no greater than 0.90 inches.

11. A reflector lamp according to claim 1, wherein said base of said nose chamber has a diameter of no greater than 0.85 inches.

12. A reflector lamp according to claim 1, wherein said base of said nose chamber has a diameter of no greater than 0.82 inches.

13. A reflector lamp according to claim 1, wherein said heat shield is positioned above said opening at said bottom of said glass shell within 4 mm thereof.

14. A reflector lamp according to claim 1, wherein said heat shield is positioned below said opening at said bottom of said glass shell within 4 mm thereof.

15. A finished reflector lamp comprising a glass shell, a base, and a wire lamp, said wire lamp being disposed within said shell, said glass shell having a concave inner surface and an outer surface, said glass shell having a thickness, said glass shell having a reflective coating disposed on said inner surface, said glass shell having a bottom, said glass shell having an opening at said bottom, said base extending from said bottom of said glass shell, said opening and said base defining a nose chamber, said nose chamber having a bottom and having a perimeter wall having an inner surface, said perimeter wall and said nose chamber bottom defining a volume inside said nose chamber, said nose chamber defining a slot having a major dimension and a minor dimension, said major dimension being substantially longer than said minor dimension, said wire lamp extending into said slot, substantially all of the perimeter wall inner surface being in fluid communication with the volume inside said nose chamber.

16. A reflector lamp as in claim 15, wherein said slot has a substantially rectangular cross-section.

17. A reflector lamp as in claim 15, wherein said slot has a substantially elliptical cross-section.

18. A reflector lamp according to claim 15, said major dimension being longer than said minor dimension by a factor selected from the group consisting of 1.5, 2, 3, 4, and 5.

19. A reflector lamp according to claim 15, said major dimension being 4 times longer than said minor dimension.

20. The reflector lamp according to claim 15, wherein the minor dimension of said nose chamber is less than one inch.

21. A reflector lamp comprising a glass shell, a base, and a wire lamp, said wire lamp being disposed within said shell, said glass shell having a concave inner surface and an outer surface, said glass shell having a thickness, said glass shell having a reflective coating disposed on said inner surface, said glass shell having a bottom, said glass shell having an opening at said bottom, said base extending from said bottom of said glass shell, said opening and said base defining a nose chamber, said nose chamber having an inner surface and a bottom said nose chamber defining a slot having a major dimension and a minor dimension, said major dimension being substantially longer than said minor dimension, said wire lamp extending into said slot, said base having a bottom, the bottom of said base of said lamp having a substantially cross-shaped cross-section.

22. A reflector lamp comprising a glass shell, a wire lamp, and a flange, said wire lamp being disposed within said glass shell, said glass shell having a concave inner surface and an outer surface, said glass shelf having a reflective coating disposed on said concave inner surface, said flange extending from said outer surface of said glass shell and defining a perimeter of a chamber, an inwardly extending overhang portion of said glass shell extending over said chamber and being substantially continuous with said glass shell, said overhang portion having an inner surface coated with said reflective coating, said overhang portion having an opening therethrough in communication with said chamber, said opening having a longitudinal dimension along a longitudinal axis and a lateral dimension along a lateral axis, said longitudinal dimension being longer than said lateral dimension.

23. A reflector lamp according to claim 22, further comprising a glass cup attached to said flange extending from said outer surface of said glass shell, said glass cup comprising a base, a wall extending from said base of said glass cup at a perimeter thereof, and a plurality of sealed openings on said base of said glass cup.

24. A reflector lamp according to claim 23, said wall of said glass cup and said flange extending from said glass shell having substantially the same diameter, said wall of said glass cup being permanently attached to said extending flange by glass flitting.

25. A reflector lamp according to claim 22, wherein said flange is integrally formed as part of said glass shell.

26. The reflector lamp of claim 22, wherein said opening is a key-shaped hole.

27. The reflector lamp of claim 22, wherein said overhang portion covers at least 50% of the space over said chamber.

28. The reflector lamp of claim 22, wherein said overhang portion covers at least 80% of the space over said chamber.

29. The reflector lamp of claim 26, wherein said overhang portion covers at least 70% over said chamber.

30. A reflector lamp comprising a glass shell, a base, and a wire lamp, said wire lamp being disposed within said shell, said glass shell having a concave inner surface and an outer surface, said glass shell having a thickness, said glass shell having a reflective coating disposed on said inner surface, said glass shell having a bottom, said glass shell having an opening at said bottom, said base extending from said bottom of said glass shell, said opening and said base defining a nose chamber, said nose chamber having a bottom and having a perimeter wall having an inner surface, said nose chamber defining a slot having a major dimension and a minor dimension, said major dimension being substantially longer than said minor dimension, said wire lamp extending into said slot, said nose chamber having a reflective coating disposed on said inner surface of said perimeter wall of said nose chamber effective to reflect light emitted by said wire lamp.

* * * * *